United States Patent [19]

Wigand

[11] 4,355,766

[45] Oct. 26, 1982

[54] DEVICE FOR THE DESTRUCTION OF MICROFILM AND SIMILAR DATA CARRIERS

[76] Inventor: Gerhard Wigand, Enzstrasse 17, 7140 Ludwigsburg, Fed. Rep. of Germany

[21] Appl. No.: 198,220

[22] Filed: Oct. 17, 1980

Related U.S. Application Data

[63] Continuation of Ser. No. 126,847, Mar. 3, 1980, abandoned, which is a continuation of Ser. No. 898,174, Apr. 20, 1978, abandoned.

[30] Foreign Application Priority Data

Apr. 20, 1977 [DE] Fed. Rep. of Germany ..... 2717522
Apr. 30, 1978 [DE] Fed. Rep. of Germany ..... 2815973

[51] Int. Cl.[3] ..... B02C 18/18

[52] U.S. Cl. ..... 241/222; 241/241; 241/243

[58] Field of Search ..... 271/121, 124, 272–275; 241/221, 222, 242, 52, 57, 60, 47, 61, 243, 59, 239, 241; 83/356.3

[56] References Cited

U.S. PATENT DOCUMENTS

| | | | |
|---|---|---|---|
| 2,669,271 | 2/1954 | Treckmann | 241/243 X |
| 3,545,686 | 12/1970 | Brown | 241/243 X |
| 3,545,689 | 12/1970 | Luscombe | 241/243 X |
| 3,779,123 | 12/1973 | Chafee | 241/243 X |

*Primary Examiner*—Mark Rosenbaum
*Attorney, Agent, or Firm*—Joseph A. Geiger

[57] ABSTRACT

A device for the destruction of microfilm and similar data carriers by shredding, the shredding cutter having a cutting edge configuration of zigzag outline with alternatingly missing teeth, offset between successive cutting edges, the data carrier feeding unit including side-by-side O-ring belts on guide rolls with forwardly biased guide pins therebetween and/or side-by-side feeding wheels on a driven shaft and separately supported forwardly biased data carrier guide tongues, for positive guidance of the data carrier material to the cutting station.

7 Claims, 22 Drawing Figures

116
102
100
22
86
24
78
14
76
74
99
58
78
76
74
83
81
63
25
93
92
95
12
91
90
97

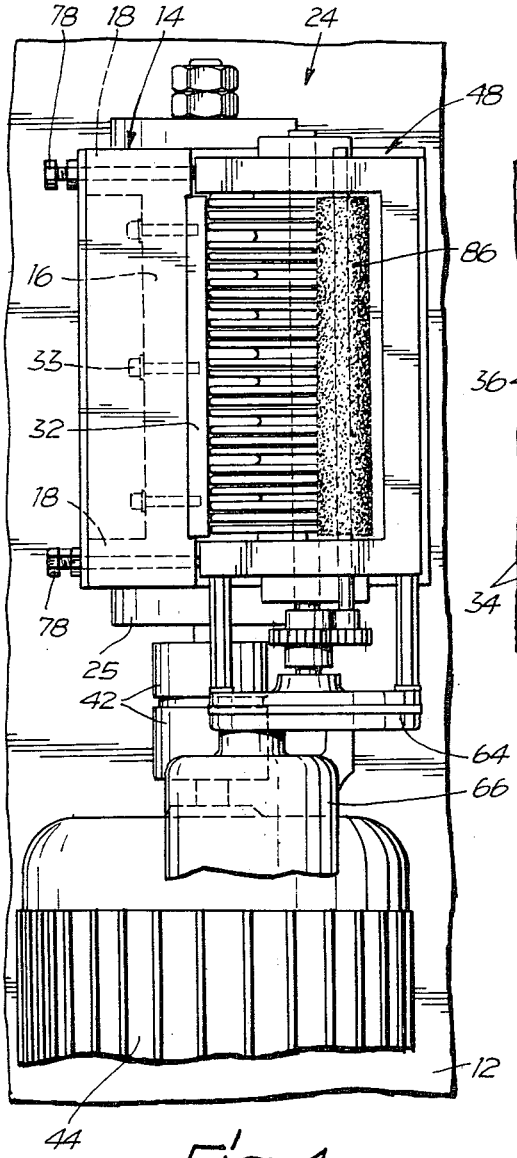
Fig. 4.
Fig. 6.
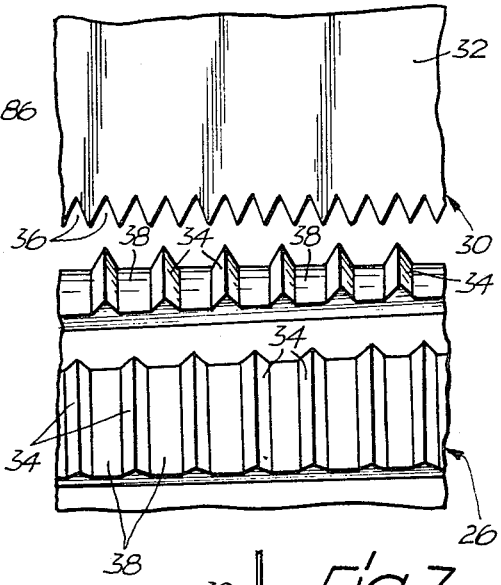
Fig. 7.
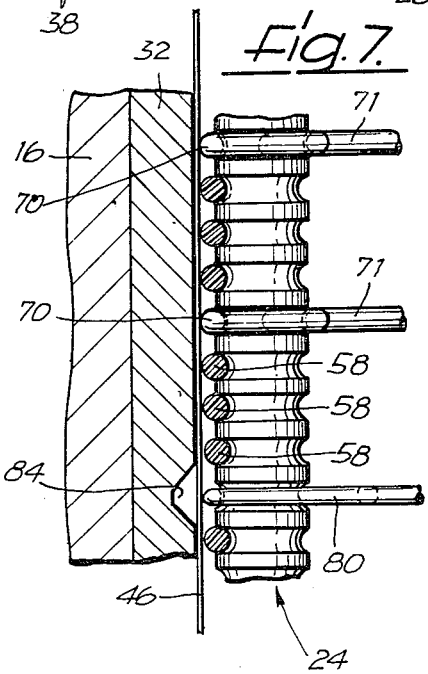

DEVICE FOR THE DESTRUCTION OF MICROFILM AND SIMILAR DATA CARRIERS

RELATED APPLICATIONS

This application is a continuation of my copending application, Ser. No. 126,847, filed Mar. 3, 1980, now abandoned, and which, in turn, is a continuation of a copending application, Ser. No. 898,174, filed Apr. 20, 1978, also abandoned.

BACKGROUND OF THE INVENTION

1. Field of the Invention

The present invention relates to shredding devices, and, more particularly, to shredding devices for the destruction of microfilm and similar information carriers which carry micro-image impressions.

2. Description of the Prior Art

In many cases, the long-term storage of written information of any kind or of comparable records involves the use of microfilm. Normally, microfilm takes the form of film reels, film sheets, so-called microfiche, or microfilm sections which form a part of a punched card. In the event that the information recorded on microfilm becomes outdated, it cannot simply be erased, due to the particular physical characteristics of these data carriers. In view of the frequently existing need to maintain confidentiality regarding such outdated information, the data carrier itself must be destroyed. This purpose is being accomplished with a device which is disclosed in my copending application, Ser. No. 949,404, filed Oct. 10, 1979, now U.S. Pat. No. 4,226,372. By means of this device the microfilm, regardless of type, including any punched cards to which it might be attached, is cut into particles so small that there is sufficient certainty that the originally existing information can no longer be deciphered. This certainty is reinforced by the fact that the cut particles are intermingled very vigorously, so that the selection and rejoining of particles which originally belonged together is made impossible.

SUMMARY OF THE INVENTION

Underlying the invention is the objective of improving the earlier-mentioned device, in order to increase the effectiveness thereof, to widen its range of application possibilities and to further improve its operational reliability.

With a structure of the device of the invention, it is the risk that cut particles which, in the course of the shredding operation, become electrostatically highly charged, would subsequently attach themselves to the wall portions of the device located adjacent the cutting station, thereby gradually diminishing the size of the discharge passage.

Feeding of the data carrier material to the cutting station is facilitated, so that even microfilm material which, for some reason, may have a coarser surface, can be shredded safety and without jamming.

The proposed improvements diminish the risk that moving parts of the data carrier feeding unit would come in contact with stationary parts of the data carrier intake unit, like the peripheral surface of the feeding wheels touching the surface of the oppositely located intake guide plate, thereby reducing the danger of creating a frictional electrical charge. This improvement also simplifies the choice of materials for the component parts of the data carrier feeding unit.

It thus becomes possible, through the extensive use of metal for the particular parts of the data carrier feeding unit, to further reduce the influence of the electrostatic charge buildup of the data carrier material and of the cut particles. It thus becomes possible to use a layer with a higher friction coefficient on the periphery of the feeding wheels or feeding rolls, which layer is preferably of electrically conductive rubber. The invention suggests the use of band-shaped or belt-shaped conveying means which produce an even feeding action on the data carrying material, over a considerable distance, and into the vicinity of the cutting station, where the data carrier material passes over feeding wheels which are arranged side-by-side on a shaft. The feeding wheels can thus be approached very closely to the moving cutting edges, because whirling cut particles cannot become lodged underneath its driving surface layer and therefore cannot lift the latter away from its support, closer to the movement path of the cutting edges, which would damage or destroy them.

The present invention also makes it possible to produce switching and control operations as, for instance, on a stack feeding unit which, following the feeding of the last sheet, is shut down, or, where the data carrier feeding unit itself can be switched on and off, when data carrier material is fed only intermittantly and in small quantities. This way, the particular unit will have a longer service life.

The proposed device further assures that, especially in conjunction with the use of a band-shaped or belt-shaped conveying means which reaches into the vicinity of the cutting station, the data carrier material is guided all along, including at its trailing end, so that there exists assurance that, in the case of the processing of microfilm sheets and punched cards, data carrier end portions are not being drawn in by the cutting edges at an elevated speed, after they leave the feeding unit, thereby protruding an inadequate shredding action. The modification called for is particularly adapted for embodiments of the device which have feeding wheels arranged in the immediate vicinity of the cutting station.

The device is preferably also equipped with a brush roll by means of which, the cut particles which become electrostatically attached to the moving parts of the data carrier feeding unit are wiped off and, because of the rotation of the brush roll, are ejected from the latter, so that an improved cleaning action takes place.

Lastly, the present invention suggests an improved cutting configuration, which specifies a so-called "alternating profile" or "tooth gap" profile on the movable cutting edges. With this cutting profile, it is possible to obtain a supplemental cutting action on the data carrier material.

BRIEF DESCRIPTION OF THE DRAWINGS

In the following, the invention will be described in more detail, with the aid of the embodiments which are shown in the drawings, as follows:

FIG. 4 shows the device of FIGS. 1 and 2 in a plan view;

FIG. 6 presents an enlarged detail of the cutting configuration of the device of FIGS. 1 and 2, as seen in the direction of arrow VI in FIG. 3;

FIG. 7 shows a portion of the data carrier feeding unit of FIGS. 1 and 2, in an enlarged horizontal cross section;

DESCRIPTION OF THE PREFERRED EMBODIMENTS

Figure 2:
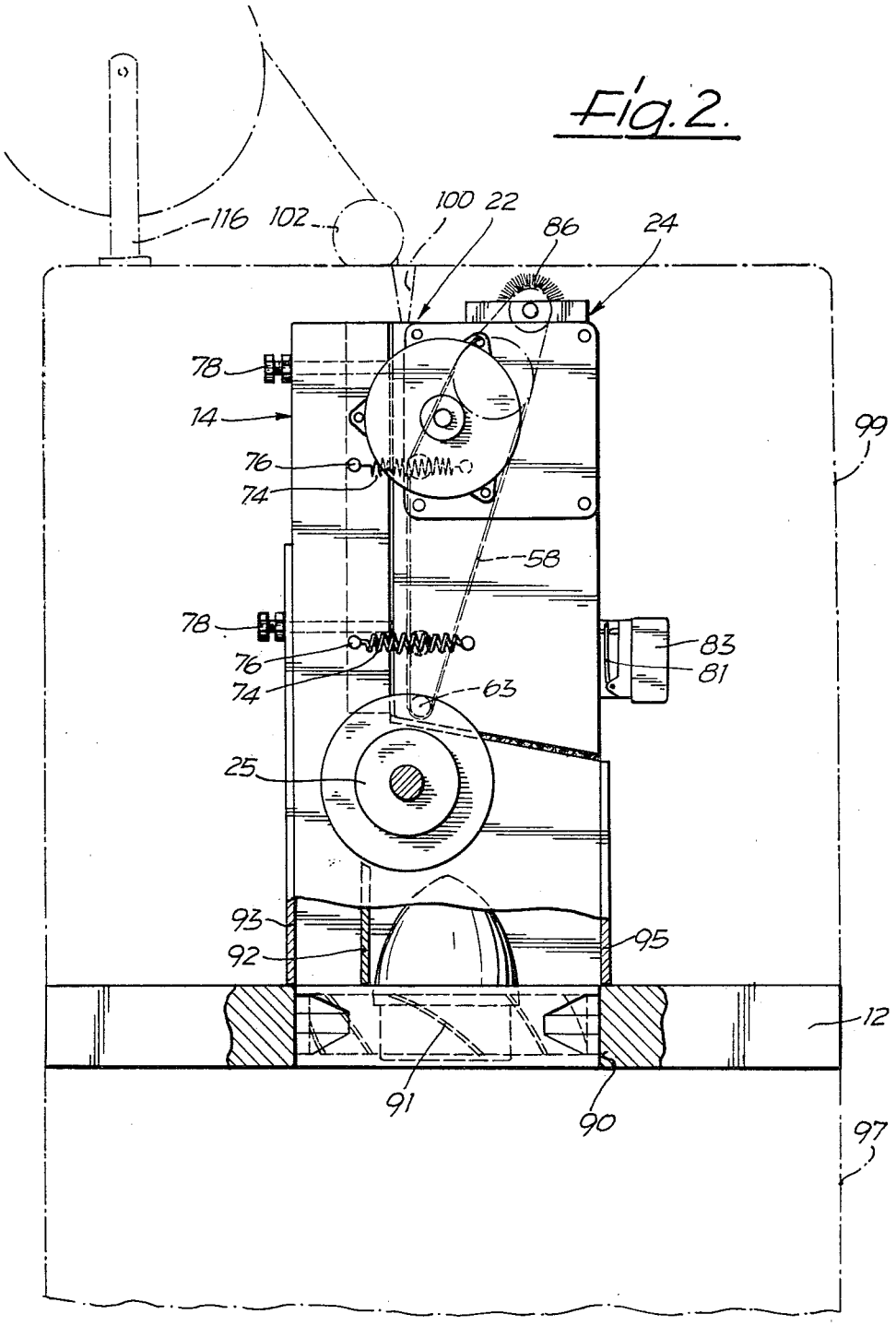
FIG. 2 shows the device of FIG. 1, in a partially cross sectioned lateral view.
Figure 3:
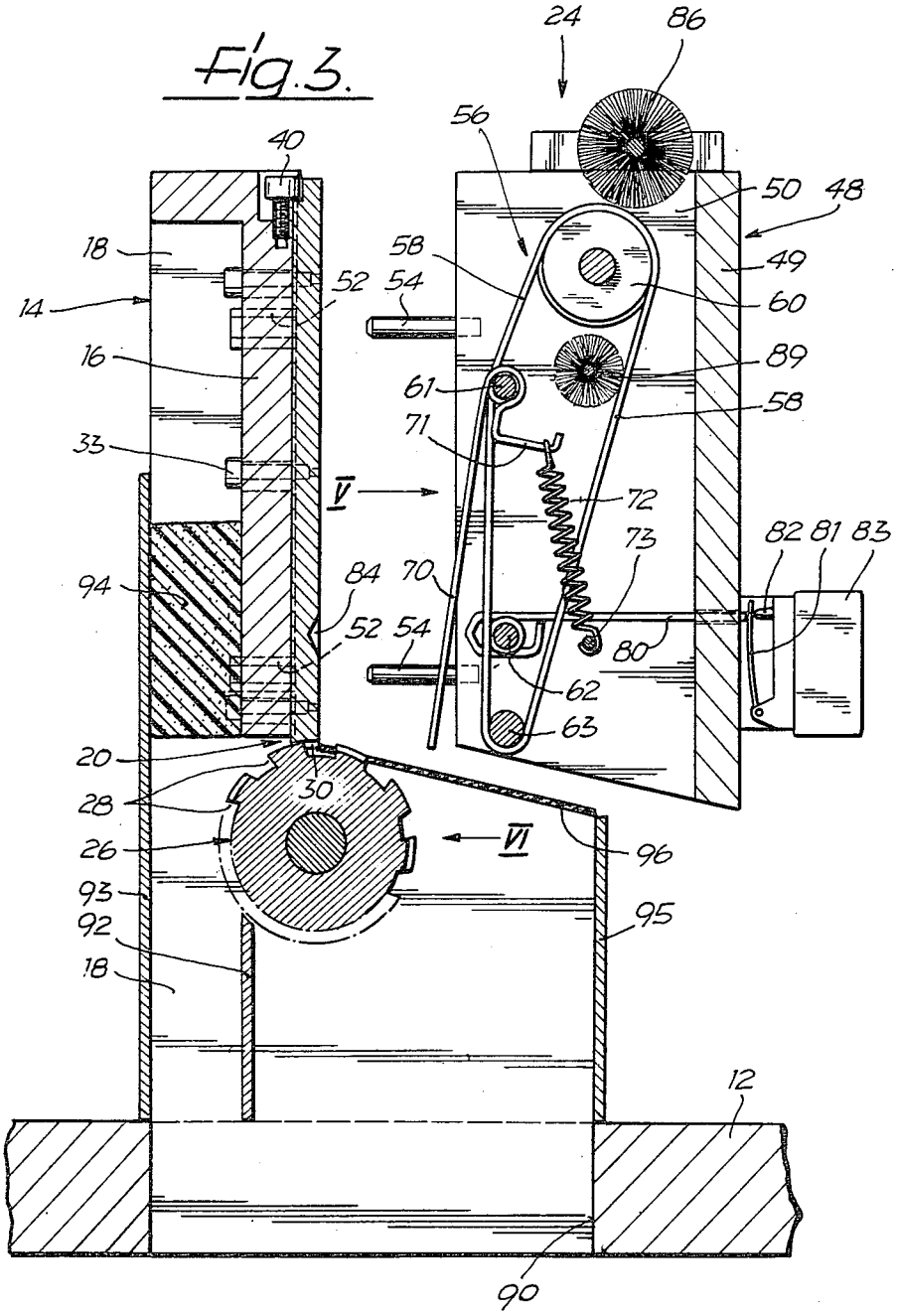
FIG. 3 shows a cross section of the device of FIGS. 1 and 2, the data carrier feeding unit having been partially removed.

The device which is illustrated in FIGS. 2 and 3 features a main frame 14 which is mounted on a base plate 12. As can be seen in FIG. 4, the frame 14, when seen from above, has a generally I-shaped outline, consisting of a web portion 16 and two flange portions 18. The main frame 14 carries a shredding cutter 20, a data carrier intake unit 22, and a data carrier feeding unit 24, which cooperates with each other.

According to FIG. 3, the web portion 16 in the lower part of the main frame 14 has been removed. Below the bottom edge of this shortened web portion 16 are arranged, in both flange portions 18, the ball bearings 25 of a milling cutter 26. The latter has a number of identically shaped cutting edges 28 which, as is shown in FIG. 6, extend on the circumference of the cutter 26, along a helix which forms a very small angle with a cylinder generatrix. The cutting edges 28 of the cutter 26 represent the moving cutting edges of the cutting unit 20. As can be seen in FIG. 3 and in FIG. 6, the cutting unit 20 includes a stationary cutting edge 30 which is formed by the edge of a plate 32 which faces the cutting station. The plate 32 is attached to the web portion 16 of the frame 14 by means of several headed screws 33. These screws 33 extend through oblong holes in the web portion 16, so that the plate 32 is adjustable in relation to the milling cutter 26. The cutter 26 is made of the same steel as conventional milling cutters, using tool steel, for example, and it is also fabricated in the same way. The material of the plate 32, which also forms the stationary cutting edge 30, is preferably brass.

As can be seen in FIG. 6, the cutting edges 28 of the cutter 26 and the stationary cutting edge 30 of plate 32, when viewed in a plane perpendicular to their relative movement path, exhibit a meander-shaped contour, formed by a zigzag line of the type found on a thread profile, which line, in relation to a common center line, forms roof-like tooth protrusions 34 on the moving cutting edges 28 and matching recesses 36 on the stationary cutting edge 30. On the multiple cutting edges 28 of the milling cutter 26, however, only every second tooth protrusion 34 of the longitudinally oriented zigzag line is present. Accordingly, there is left an enlarged tooth gap 38 between each pair of tooth protrusion 34. As is clearly visible in FIG. 6, the tooth protrusions 34 and the intermediate gaps 38 of successive cutting edges are offset against each other.

The stationary cutting edge 30 at the lower edge of the guide plate 32 is obtained in a most simple manner by using a feed screw 40 in the web portion 16 to advance the guide plate 32 towards the rotating milling cutter 26, while the attachment screws 33 are only lightly tightened, with the result that the tooth protrusions 34 of the moving cutting edges 26 cut the tooth gaps 36 for the stationary cutting edge as a matching counter-profile into the edge of the guide plate 32.

The drive for the milling cutter 26 includes an elastic coupling 42 and an electric motor 44 which is mounted on the base plate 12.

In FIG. 7 can be seen that the data carrier material 46, which may be available in the form of microfilm sheets, punched cards with microfilm inserts, or the like, is fed along the guide plate 32 to a cutting station, where the stationary cutting edge 30 and one of the moving cutting edges 28 of the cutter 26 cooperate in a cutting engagement which can be seen in FIG. 3. The guide plate 32 thus serves not only as the cutter body which supports the stationary cutting edge 30, but also as an intake guide surface for the data carrier material 46. Accordingly, the guide plate 32 forms a portion of the data carrier intake unit 22.

Figure 5:
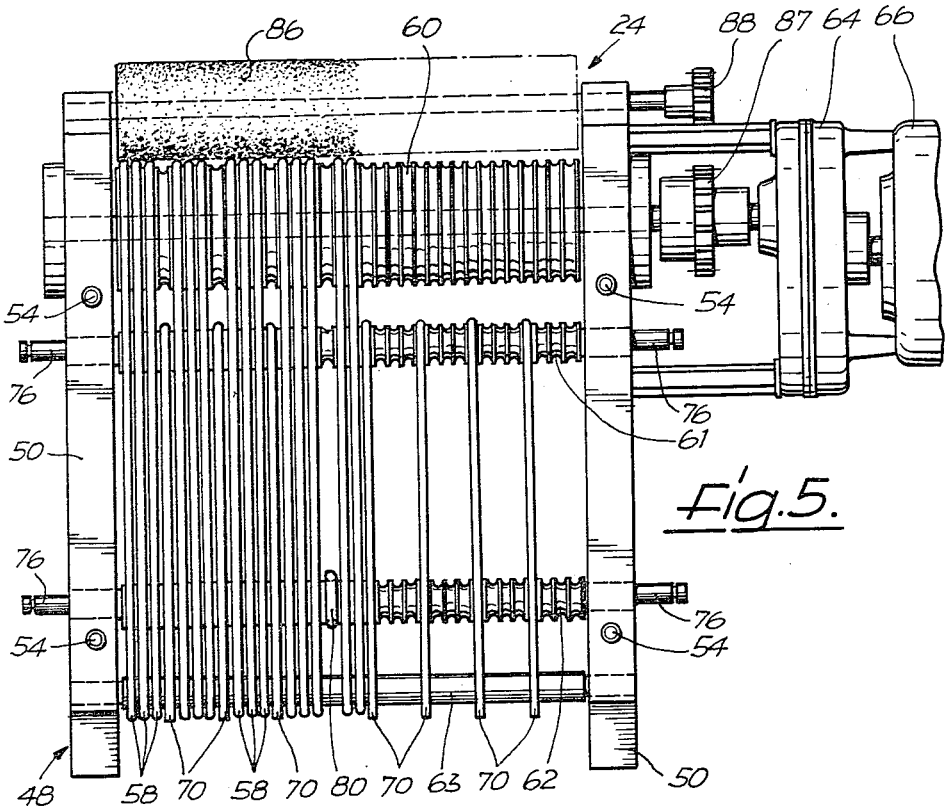
FIG. 5 shows the data carrier feeding unit of the device of FIGS. 1 and 2, as seen in the direction of arrow V in FIG. 3.

As can be seen from FIGS. 3 and 5, the data carrier feeding unit 24 represents a self-contained subassembly. Its constituant parts are mounted on a separate frame 48 of U-shaped outline, consisting of a transverse wall 49 and two flange portions 50. As is shown in FIG. 3, that part of the flange portions 18 of the main frame 14 which is located above the cutter 26 is removed on one side to such an extent that the flange portions 50 of the frame 48 of the data carrier feeding unit 24 can take the place of the removed flange portions. The data carrier feeding unit 24 is guided in relation to the main frame 14, using the remaining length of the flange portions 18 above the cutter 26, where ball bushings 52 are arranged in parallel bores and cooperate with matching guide trunnions 54 which are seated in the flange portion 50 of frame 48.

The data carrier feeding unit 24 features an endless conveying means 56 of belt-like appearance. It consists essentially of a number of endless O-rings belts 58 of elastic material, in a side-by-side arrangement.

The conveying means 56 is guided over four guide rolls 60, 61, 62, and 63, which are arranged at different locations in relation to the cutting station. The guide roll 60 which is located farthest from the cutting station has a relatively large outer diameter and also serves as the drive drum for the conveying means 56. It is driven by means of an electric motor 66 and a gear unit 64 which are both mounted on the frame 48. The other three guide rolls 61, 62, and 63 have a much smaller diameter than the drive roll 60. The guide roll 63 which is located closest to the cutting station has a smooth cylindrical surface. The other two small guide rolls 61 and 62, as well as the large, driven guide roll 60, have on their circumference a number of axially spaced guide grooves 68 of a cross-sectional outline which is adapted to the O-ring belts 58.

The guide rolls 60, 61, 62, and 63 are supported in the two flange portions 50 of frame 48 by means of ball bearings. The guide rolls 61, 62 and 63 are so arranged that the length portions of the O-ring belts 58 which run between them extend in a plane that is parallel to the guide plate 32 which serves as an intake guide table. The length portions of the O-ring belts extending between the drive rolls 60 and 61 extend in a plane which forms an acute angle with the plane of the guide plate 32, so that this portion of the conveying means 56 constitutes an intake slope for the data carrier material.

As can be seen in FIGS. 5 and 7, the O-ring belts 58 area arranged in groups of three belts each. Inbetween successive groups, there is each time one O-ring belt missing. In their places are arranged guide pins 70. The guide pins 70 have on one side end portions which are bent into an eye-shape, serving as a pivot support from which the straight main portions of the guide pins 70 extend in the direction of the data carrier advance, beyond the contact point of the conveying means 56 which is closest to the cutting station. The eye-shaped end portions of the guide pins 70 are hooked over the guide roll 61. As can be seen in FIG. 3, the eye-shaped end portions of the guide pins 70 have an extension 71 which forms an angle with the pin main portions, away from the movement path of the data carrier. To the extremity of each extension 71 is attached one end of a tension spring 72, the other end of the latter being attached to a transverse rod 73 which is supported by its extremities in bores of the flange portions 50 of the frame 48. The tension springs 72 apply to the extensions 71 of the guide pins 70 a pivoting force which urges the free extremities of the guide pins 70 forward from the plane of the conveying means 56, towards the movement path of the data carrier material (see FIG. 3).

The data carrier feeding unit 24 which, by virtue of its guide trunnions 54 and ball bushings 52 is supported for movement parallel to itself, is maintained in its operating position, seen in FIG. 2, by means of tension springs 74. These tension springs have ring-shaped extremities engaging studs 76 which are seated in bores of the flange portions 18 of the main frame 14, or in the flange portions 50 of frame 48, respectively. An exact determination of the operating position of the data carrier feeding unit 24 relative to the guide plate 32 is obtained by means of adjustment screws 78 which are seated in threaded bores of the flange portions 18 of the main frame 14 and which are threaded into their bores to such an extent that their shaft extremities protrude from the flange portions 18 by a distance which allows the flange portions 50 of frame 48 to abut against them in the correct operating position.

As can be seen in FIG. 5, the data carrier feeding unit 24 has in about the center of its conveying means 56 one of its O-ring belts missing. In its place is arranged, on the guide roll 62, the oblong eye-shaped end portion of a movable sensing member 80, the outline of which can be seen in FIG. 3. This sensing member 80, cooperating with a guide blade 81, engages the actuating pin of a limit switch 83. A return spring which engages the actuating pin 82 inside the limit switch 83 imposes a bias on the sensing member 80 in the direction towards the guide plate 32, so that its sensing extremity at the oblong eye portion protrudes beyond the plane of the conveying means 56 and of the data carrier material 46, as shown in FIG. 3. In alignment with the movement path of the sensing extremity of the sensing member 80, the guide plate 32 has a recess 84 into which the sensing member 80 can freely penetrate, when no data carrier material is present between the guide plate 32 and the conveying means 56. As soon as the conveying means 56 advances a data carrier 46 between it and the guide plate 32 in the direction towards the cutting station, the data carrier engages the inclined portion of the sensing extremity of the member 80, pushing it back into alignment with the plane of the conveying means 56, thereby actuating the limit switch 83.

On top of the data carrier feeding unit 24 is arranged a brush roll 86 which is journalled in the frame 48. The brush roll 86 is driven for rotation in a circumferentially opposite sense to the movement of the conveying means 56 by means of a chain drive which is represented by the sprockets 87 and 88, using the driven roll 60 as a drive source. Below the driven roll 60 is arranged a second brush roll 89 which, while being of the same type as the brush roll 86, is stationary.

In FIGS. 2 and 3, it can be seen that the base plate 12 is provided with an aperture 90 underneath the milling cutter 26, for the discharge of the cut particles. This aperture 90 extends laterally between the two flange portions 18 of the main frame 14 and has a square outline. Inside the aperture 90 is arranged an exhaust blower 91 which is mounted on the base plate 12. The frame of the exhaust blower 91 has a square exterior outline and it thus completely fills out the aperture 90. Above the blower 91 is further arranged a guide baffle 92 which extends laterally between the flange portions 18 of the main frame 14 and reaches upwardly as far as the circumference of the milling cutter 26. On the outside of the flange portions 18 is further arranged a second guide baffle 93 whose lower extremity sits on the base plate 12. In the area above the cutting station, the space left between this guide baffle 93 and the web portion 16 of the main frame 14 is filled in with a foam rubber block 94, so that the space between the guide baffles 92 and 93 and between the flange portions 18 is tightly sealed off to the outside. On the other side of the main frame 14 is arranged a vertical cover panel 95 which seals off the space above the exhaust blower 91 by likewise engaging the flange portions 18. In order to further seal off the inner space above the exhaust blower 91 against the outside, there are arranged foam rubber strips 96 on the inclined upper edges of the flange portions 18 of frame 14, where the flange portions form a recess, as can be seen in the lateral cross section of FIG. 3. The lower edges of the flange portions 50 of frame 48 abut against the foam rubber strips 96, when the data carrier feeding unit 24 is in its operating position. Accordingly, when the device is in operation, the exhaust blower 91 can receive its intake air only from above, via the space which is enclosed by the transverse wall and by the two flange portions 50 of the frame 48, on the one hand, and by the guide plate 32, on the other hand. It follows that the suction effect of the blower 91 is directed in its entirety against the cut particles which emanate from the cutting station and of which the major portion is therefore sucked downwardly through the passage formed by the guide baffles 92 and 93 and by the flange portions 18, while that small portion of the particles which is carried beyond the guide baffle 92 by the cutter 26 is sucked downwardly through the passage formed by the guide baffle 92 and the cover panel 95. Underneath the aperture 90 and exhaust blower 91, in a space formed by the base 97 of the enclosure 98 (see FIG. 1), is arranged a receiving trough or bag (not shown) for the collection of the cut particles.

Figure 1:
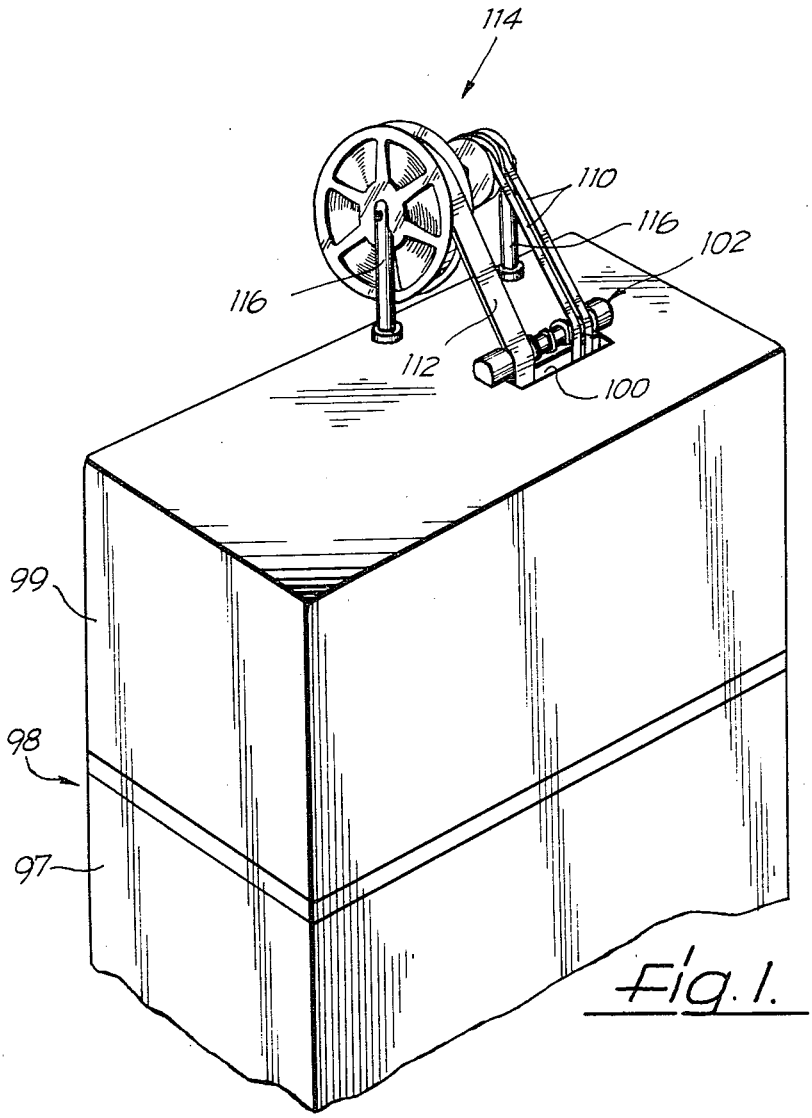
FIG. 1 is a perspective exterior view of a device embodying the invention, the device being surrounded by an enclosure which carries a device for unwinding microfilm reels.

As FIG. 1 shows, the enclosure 98 also includes a hood 99 which encloses and covers the entire device. In the top panel of the hood 99 is arranged a funnel-shaped intake opening 100 for the data carrier material 46. On the upper side of the hood 99, in the immediate vicinity of the intake opening 100, is mounted a film guide 102. The latter has the shape of an elongated roller of circular cross section, as can be seen in FIG. 9. On both extremities of the film guide 102 is arranged a cylindrical end collar 104 (FIG. 8) with a flat face on one side. This face serves as a mounting surface for the end collars 104 on the outer side of the enclosure hood 99. Between the end collars 104 are arranged two groups of guide discs 106 and 107 which are spaced apart at least 18 mm. The guide discs 106 have a smaller diameter than the guide discs 107, whose outer diameter is equal to the diameter of the end collars 104. The larger guide discs 107, therefore, have a facet in alignment with the mounting faces of the end collars 104 with which they engage the hood 99. In addition thereto, the larger guide discs 107 also have a facet 108 extending at least approximately perpendicularly to the first-mentioned facets.

Figure 8:
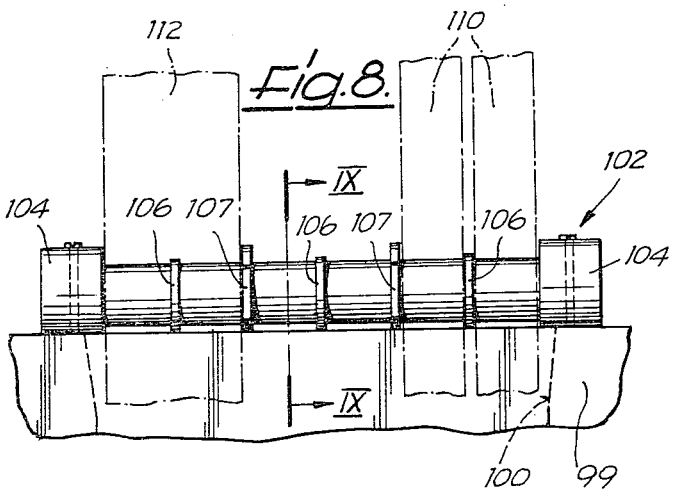
FIGS. 8 and 9 show a frontal view and a cross section, respectively, of the film guide of the device for unwinding microfilm reels, shown in FIG. 1.
Figure 9:
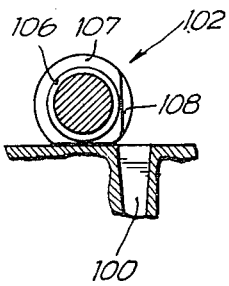

As can be seen in FIG. 8, the guide disc nearest the end collar 104 is a small guide disc 106, which is followed by a larger guide disc 107, followed again by a smaller guide disc 106, and so on, until the last small guide disc 106 is followed by the opposite end collar 104. As is illustrated in FIG. 1, microfilms on reels of a width of 18 mm can be fed between any pair of guide discs 106 and 107 or between a guide disc 106 and the end collar 104, as they pass over the film guide 102 into the intake opening 100. Microfilm 112 on reels, having a width of 36 mm, can only be fed between two larger guide discs 107, or between a guide disc 107 and an end collar 104. The upright facets 108 on the large guide discs 107 facilitate the feeding of microfilm sheets which, in the absence of the facets, would have to be inserted obliquely from the side.

As can be seen in FIG. 1, the enclosure hood 99 also carries a film reel unwinding device 114. The latter includes two upright supports 116 which are removably inserted in positioning holes of the hood 99. The upper end portions of the two supports 116 form recesses which face one another and which support the extremities of a horizontal shaft on which only one extremity is visible. The various film reels are inserted over this shaft and the starting end of each film is placed over the film guide 102 and inserted into the intake opening 100.

Figure 10:
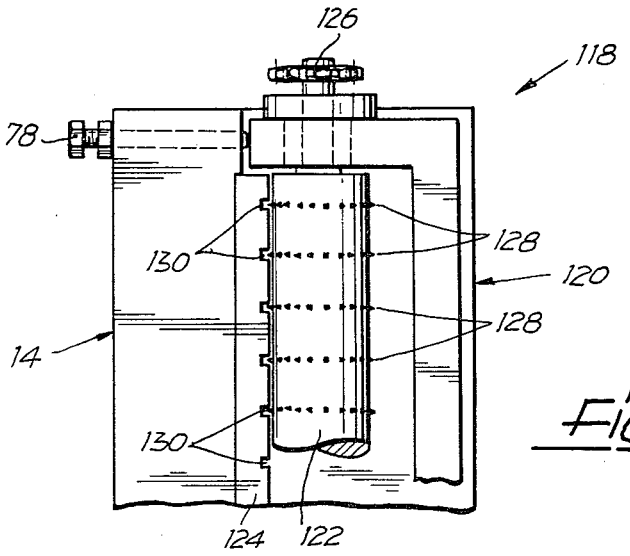
FIG. 10 shows a partial plan view of a second embodiment of the data carrier feeding unit of the device of FIGS. 1 and 2.
Figure 11:
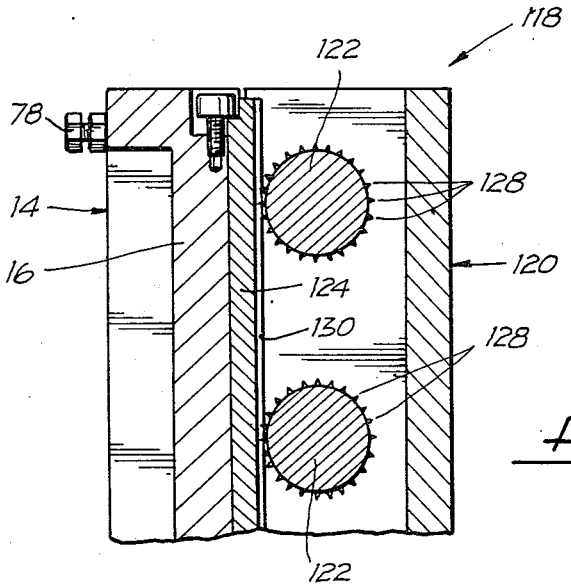
FIG. 11 is a partial cross section through the data carrier feeding unit of FIG. 10.

FIGS. 10 and 11 show a modified data carrier feeding unit 118. The frame 120 of this unit is likewise U-shaped in its plan view outline. Similarly, it is movably guided with respect to the main frame of the device by means of guide trunnions and ball bushings. However, in this case, the conveyor means consists of separate intake rolls 122 which are arranged parallel to each other and spaced along the extent of the guide plates 124, the intake rolls 122 being journalled in the frame 120. A chain drive, of which only one sprocket 126 is visible in FIG. 10, serves to drive the intake rolls 122. Each of the latter has on its circumference a number of annular rows of spine-like protrusions 128. In alignment with these protrusions 128 are arranged appropriate grooves 130 in the guide plate 124, the bottoms of the grooves 130 being deep enough that the protrusions 128 cannot touch them. While these grooves would be necessary only in the immediate vicinity of each intake roll 122, the machining of the guide plate is simplified by providing continuous longitudinal grooves 130 in the guide plate 124.

In FIG. 11, the two intake rolls 122 shown are arranged at a comparatively large spacing along the movement path of the data carrier material. In reality, these intake rollers are preferably arranged at a minimal distance from each other.

In the place of the cylindrical intake rolls 122, it is also possible to arrange, on a common shaft, several separate intake wheels which likewise carry a number of annular spine-like protrusions on their circumference, while matching grooves are arranged in the guide plate. While the spine-like protrusions assure a reliable engagement of the data carrier material, it could also be visualized that the intake rolls, or intake wheels, could be provided with a circumferential rim of a material which has a high friction coefficient.

In all embodiments of the data carrier intake unit, the advance of the data carrier material towards the cutting station is preferably further facilitated through the application to the surface of the guide plate facing the data carrier material of a coating having a low friction coefficient, the material being preferably polytetrafluoroethylene, applied by spraying or casting, or in the form of a film which is glued or welded onto the guide plate.

In the following will be described, with reference to FIGS. 12 through 16, another embodiment of a data carrier feeding unit 131 which can be used in the place of the feeding unit 24 of FIGS. 3 through 5 and which incorporates certain modified component parts or subassemblies. To the extent that other component parts of this unit are not specifically described, it should be assumed that they are at least similar to corresponding component parts of the earlier-described embodiment, so that reference can be had to the corresponding portions of the foregoing description.

The data carrier feeding unit 131 represents again a self-contained subassembly the component parts of which are arranged in a separate frame 132. The frame 132 resembles the frame 48 of the data carrier feeding unit 24 and, like the latter, is movable parallel to itself relative to the main frame 14.

The data carrier feeding unit 131 consists of two major components which are arranged one behind the other with relation to the movement direction of the data carrier material. One of these major components is an annular endless, overall band-shaped conveying means 133 which consists of a number of endless O-ring belts 134 of elastic material, arranged side-by-side. The other major component is constituted of a number of intake wheels 135 which are arranged side-by-side on a common shaft 136.

The conveying means 133 is guided over three guide rolls 137, 138, and 139, of which the guide rolls 138 and 139 have the same diameter. The guide roll 137, shown to have a larger outer diameter, could, in the case of the data carrier feeding unit 131, also have the same outer diameter as the other two guide rolls. All three guide rolls 137, 138, and 139 have arranged on their circumference a series of axially regularly spaced guide grooves 141 with a cross-sectional outline that corresponds to the profile of the O-ring belts 134.

All three guide rolls 137, 138, and 139 are journalled in the frame 132. The two guide rolls 138 and 139 are so arranged that the length portion of the O-ring belts 134 extending between them defines a plane which, in the operating position of the data carrier feeding unit 131, extends parallel to the guide plate 32 of the main frame 14.

Figure 13:
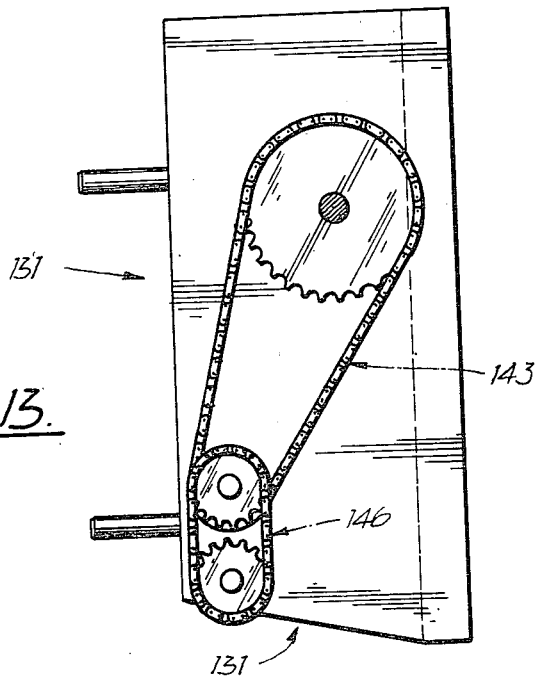
FIG. 13 shows a side view of the data carrier feeding unit of FIG. 12.
Figure 14:
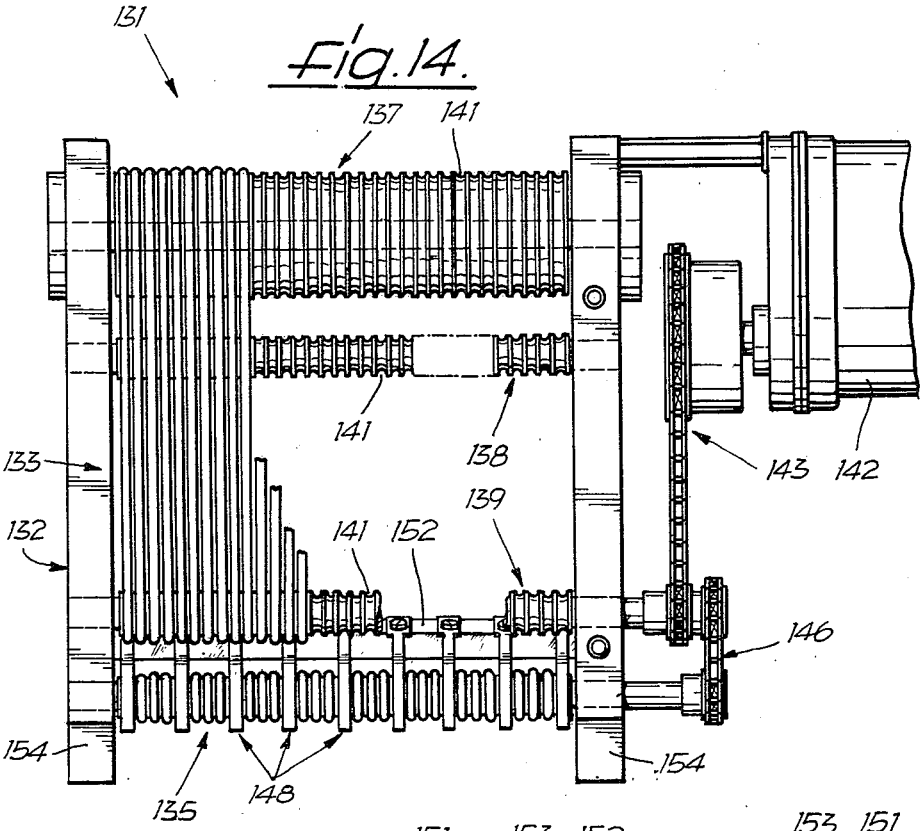
FIG. 14 shows a front view of the data carrier feeding unit of FIGS. 12 and 13.

As can be seen in FIGS. 13 and 14, the guide roll 139 which is located closest to the cutting station is the driven guide roll. It is driven by means of a chain drive 143 and a gear motor 142 which is mounted on the frame 132.

Figure 15:
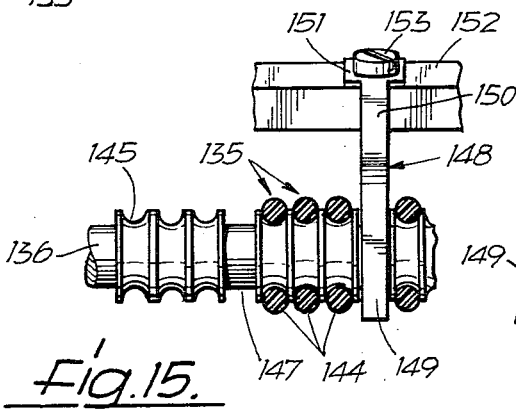
FIG. 15 shows, at an enlarged scale, certain details of the front view of FIG. 14.

As can be seen in FIG. 15, the intake wheels 135 are rubber rims 144 of round cross section. They are seated in corresponding peripheral grooves 145 of the shaft 136. The shaft 136 is likewise journalled in the frame 132. It is driven by means of a chain drive 146, using a double sprocket on the driven guide roll 139 which receives its drive from the gear motor 142. The diameter of the rubber rims 144 and the diameter of the circumferential grooves 145 supporting them, as well as the location of the axis of the shaft 136 on the frame 132 are so coordinated that the contact plane of the O-ring belts 134 in the belt run portion between the guide rolls 138 and 139 coincides with the contact plane of the rubber rims 144. The drive ratio of the chain drive 146 is so selected that the circumferential speed of the rubber rims 144 equals the circumferential speed of the O-ring belts 134 on the driven guide roll 139.

Figure 12:
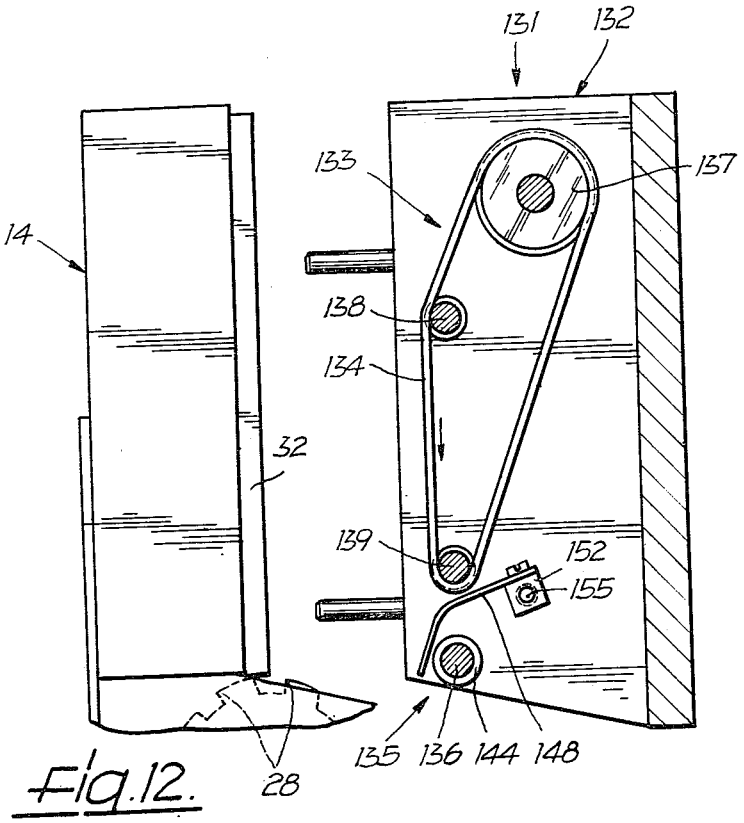
FIG. 12 is a cross section of a further modified data carrier feeding unit of the device of FIGS. 1 and 2.
Figure 16:
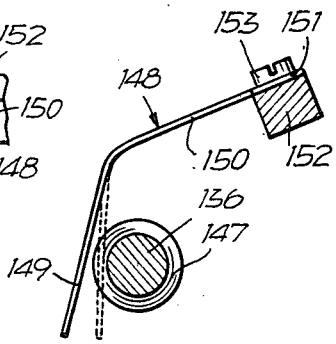
FIG. 16 is a transverse cross section corresponding to the detail shown in FIG. 15.
Figure 17:
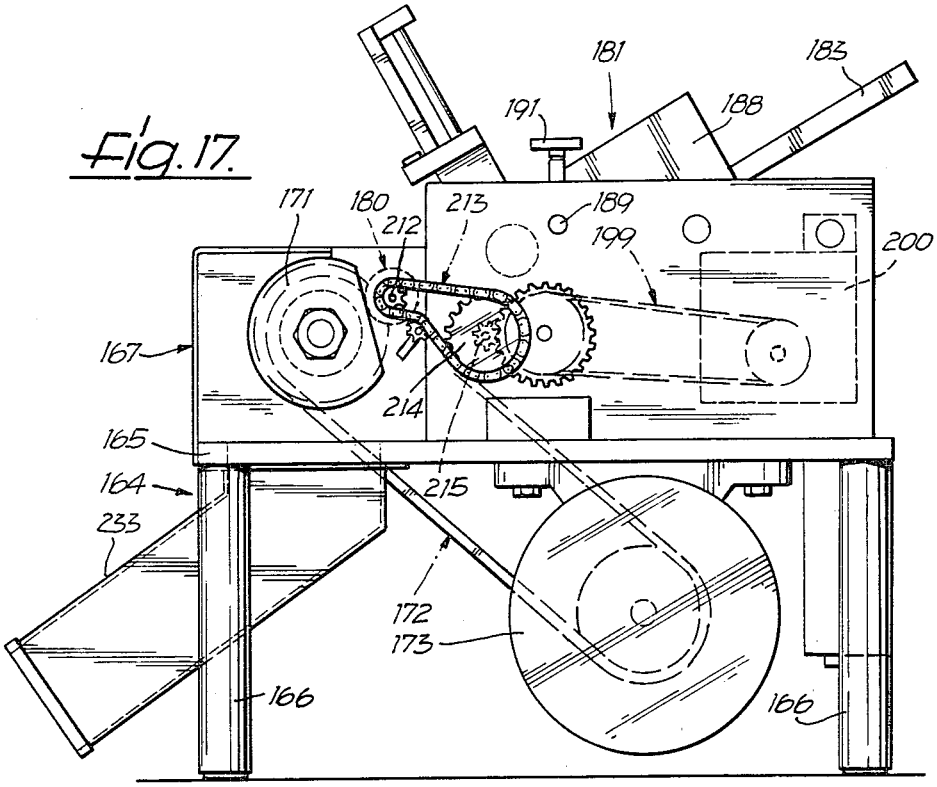
FIG. 17 shows, in a lateral view, a third embodiment of the device of the invention.

As can be seen in FIGS. 14 and 15, the rubber rims 144 are arranged in groups of three, side-by-side. Between every two groups, there is one rim missing. In the places where the rubber rim 144 is missing, the shaft 136 has a peripheral groove 147 of rectangular cross section. Aligned with each groove 147 is a guide element 148 in the form of a narrow, thin tongue of resilient metal. As can be seen in FIGS. 12 and 16, the guide tongues 148 have two length portions 149 and 150 forming an obtuse angle between them. On the length portion 150 which faces away from the shaft 136, the guide tongue 148 forms an enlarged mounting tab 151 with a central hole. The mounting tabs 151 of the guide tongues 148 are clamped onto a common surface of a transverse supporting rod 152 by means of clamping screws which extend through the holes of the mounting tabs into a threaded bore of the transverse supporting rod 152, thereby clamping the guide members in place. The forward length portion 149 of each guide tongue 148 is aligned with a groove 147 in the shaft 136, as can be seen in FIG. 15. The length portion 149 of the guide tongue 148 is narrower than the width of the peripheral groove 147, so that the length portion 149 can enter the groove 147, under elastic deformation, as is indicated in FIG. 16 by a dotted line. The mounting rod 152 extends between the two flange portions 154 of the frame 132. On both extremities, it has threaded bores 155 which are engaged by clamping bolts reaching inwardly through appropriate bores in the flange portions 154.

The guide tongues 148 are so shaped, and the supporting rod 152 is so arranged on the frame 132, that the free end portions of the guide tongues 148 engage the guide plate 32 of the main frame 14 in the operational position of the data carrier feeding unit 131 in as even a manner as possible, extending along the movement path of the cutting edges 28 which are shown in part only in FIG. 12. It is advantageous to make the guide tongues 148 initially slightly longer, so that, following assembly of the device, the movable cutting edges 28 will cut the guide tongues to the right length.

In operation, the data carrier material, exemplified by microfilm cards or punched cards with microfilm inserts, is inserted into the intake chute which is formed by the inclined portion of the conveying means 133 running between the drive rolls 137 and 138. This conveying means which, as an assembly, performs like a belt, advances the data carrier material in the direction towards the cutting station which is the point where the stationary cutting edge 30, in the form of the lower border of the guide plate 32, meets the moving cutting edges 28 of the cutter 26. The leading extremity of the data carrier material, after leaving the conveying means 133, is pushed forwardly into the gap between the guide tongues 148 and the guide plate 32, until it is seized by the feeding wheels 135 and further advanced to the cutting station. During this time, the main portion of the data carrier is still being advanced by the conveying means 133. As soon as the trailing extremity of the data carrier has left the feeding wheels 135, the residual length portion of the data carrier which remains between the feeding wheels 135 and the cutting station is retained by the guide tongues 148. This feature prevents the possibility that the residual length portion of the data carrier is advanced at an increased rate by the moving cutting edges 28, thereby producing large cut particles which might carry sufficiently large portions of the original information that they could be partially deciphered. The subsequently entering data carrier pushes the residual length portion of the preceding data carrier towards the cutting unit 160, at the normal rate of advance, so that it is shredded in the normal manner. For the shredding of the very last residual length portion of a data carrier, it is sufficient to insert a plain sheet of paper into the device.

In the following will be described, with reference to FIGS. 17 through 22, a different embodiment of the device for the destruction of microfilm. The cutting unit 160 of this device, consisting of a stationary cutting edge 161 and a series of moving cutting edges 162, resembles to a large extent the previously described embodiments. Major modifications, however, are suggested with respect to the arrangement and the structure of the feeding unit 163 for the data carrier material and, in connection therewith, the main frame 164 of the device which carries the cutting unit 160 and the data carrier feeding unit 163.

Figure 19:
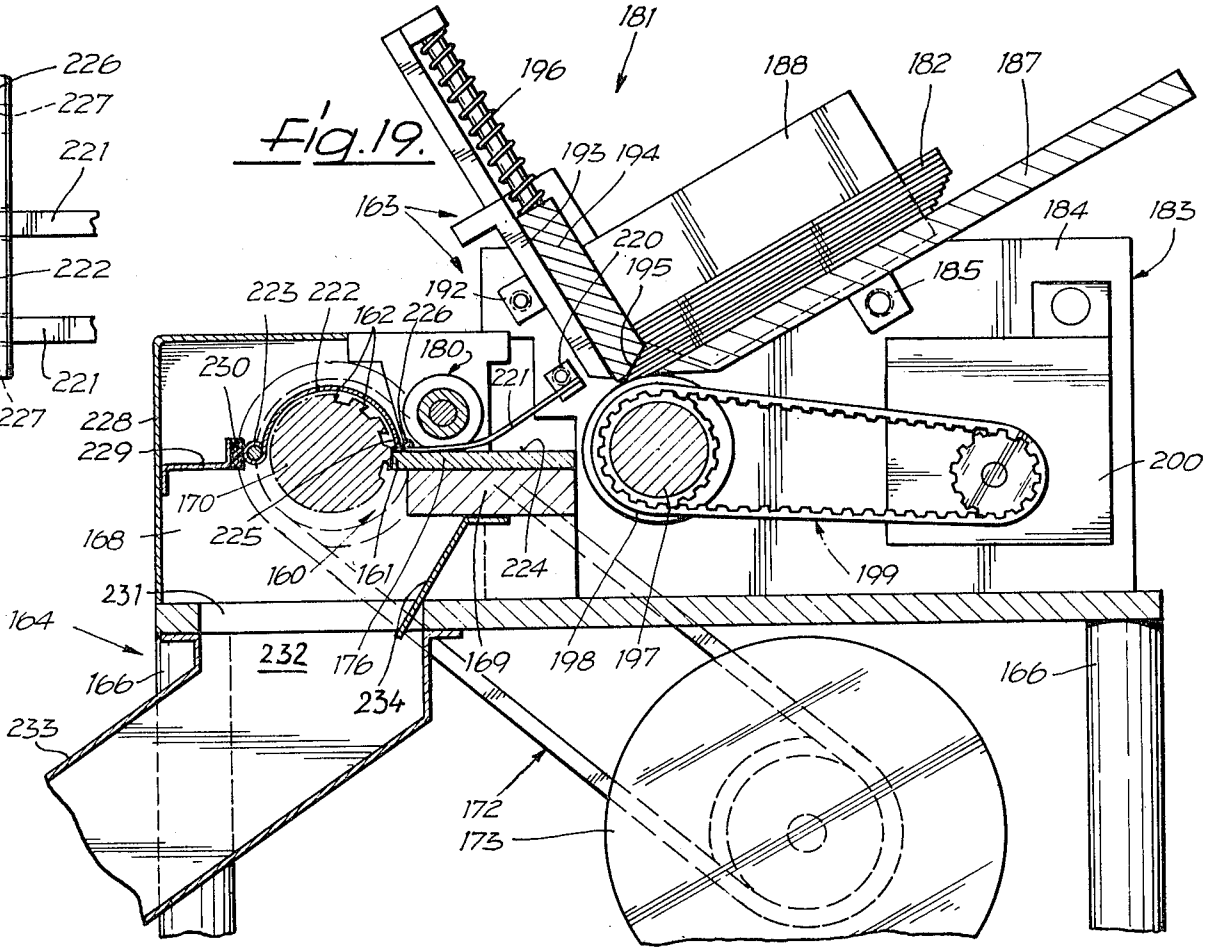
FIG. 19 is a longitudinal cross section through the device of FIGS. 17 and 18.
Figure 20:
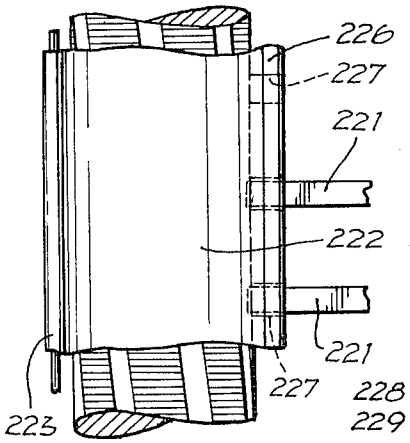
FIG. 20 shows, at an enlarged scale, certain details of the plan view of FIG. 18.

The main frame 164 consists essentially of a base plate 165 which rests on four columnar legs 166. Mounted on top of the base plate 165 is a main frame 167 for the cutting unit 160. The main frame 164 has an H-shaped cross-sectional outline which can be seen in FIG. 21, consisting of two flange portions 168 and a web portion 169 which may be constituted of separate plates that are bolted together, as is the case in FIG. 21, or which may be integral portions of a casting. As can be seen in FIG. 19, the web portion 169 extends over only a portion of the length of the flange portions 168, leaving an aperture in the web portion of the main frame 167 for the accommodation therein of a milling cutter 170 which carries the moving cutting edges 162 and rotates about a horizontal axis.

The milling cutter 170 is rotatably supported in ball bearings which are seated in bearing flanges 171, mounted on the outside of the flange portions 168. An electric motor 173, mounted on the underside of the base plate 165, drives the milling cutter 170 by means of a V-belt drive 172. For this purpose, the shaft of the milling cutter 170 has an extended trunnion reaching beyond the bearing flange 171 and carrying thereon a V-belt pulley 174 for the belt drive 172. The V-belt 175 runs through an oblong opening 176 in the base plate 175, linking the pulley 174 with a drive pulley which is seated on the shaft of the electric motor 173.

The stationary cutting edge 161 is formed by that edge of a guide table 176 which is located at the path of the moving cutting edges 162, in the same manner as in the previously described embodiments. The guide table 176, thus constituting the supporting body of the stationary cutting edge 161, is again a brass plate, supported by the web portion 169 of the main frame 167 and clamped in place by means of screws (not shown). These clamping screws extend through oblong holes in the web portion 169, so that the guide table 176 with its stationary cutting edge can be shifted in relation to the moving cutting edges 162. The stationary cutting edge 161 receives its intended zigzag-shaped cutting outline in a machining operation of the milling cutter 170, as the originally smooth edge of the guide table 176 is approached against the moving cutting edges 162 of the cutter 170, with only lightly tightened guide table clamping bolts, the cutter 170 thereby producing an exactly matching stationary cutting edge 161 on the guide table 176.

The data carrier feeding unit 163 consists primarily of a number of feeding wheels 180 and of a sheet stack feeding device 181. The sheet stack feeding device, in the following simply referred to as stack feeder 181, has for its purpose to singulate separate sheets or cards from a stack of microfilm sheets or microfilm punched cards, as is illustrated in FIG. 19. The sheets which are singulated by the stack feeder 181 are then pulled into the device by the feeding wheels 180 and advanced towards the cutting unit 160.

The stack feeder 181 is a self-contained subassembly with a separate frame 183, consisting of two side walls 184 and a transverse tie member 185. The side walls 184 are bolted to the base plate 165 and to the flange portions 168 of the main frame 167. The tie member 185 is clamped between the side walls 184 by means of screws 186 which engage appropriate threaded bores in the two extremities of the tie member 185.

Figure 18:
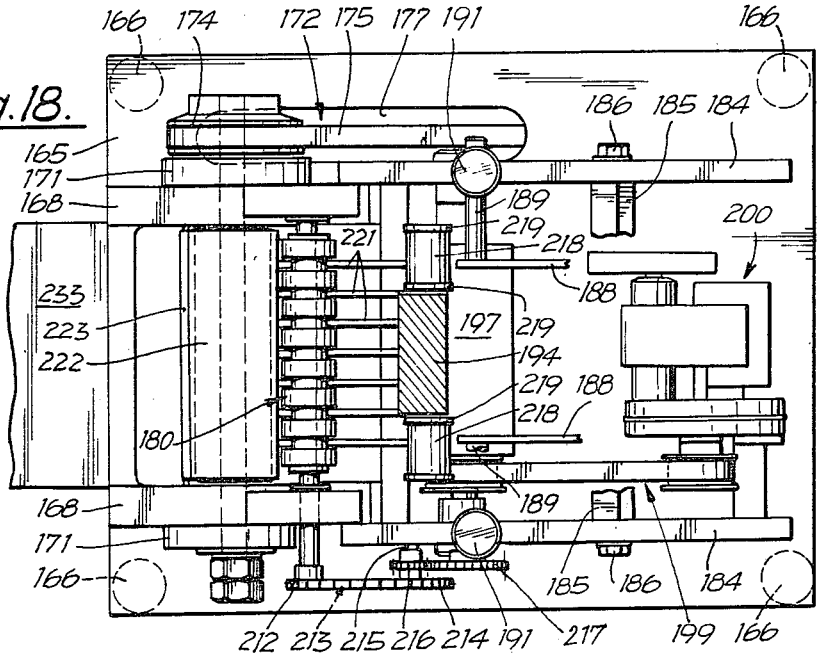
FIG. 18 is a partially cross-sectioned plan view of the device of FIG. 17.

The stack feeder 181 has a stack table 187 for the support of the sheet stack 182. The stack table 187 consists of several narrow slats which are mounted in parallel and laterally spaced from each other on the tie member 185. On their extremities facing towards the cutting unit 160, the slats of the stack table 187 are chamfered in the manner of a chisel. In the illustration of FIG. 18, the slats have been left out, in order to show the parts which lie below them. Of the tie member 185 are shown only the end portions which are attached to the side walls 184.

The lateral alignment and guidance of the sheet stack 182 is obtained by means of two guide members 188 which are arranged on opposite sides of the stack table 187. These guide members are metallic plates of rectangular elevational outline, having one corner cut off. To each of the two guide members 188 is attached a mounting rod 189 which extends laterally outwardly from the plate and through a supporting bore in the associated side wall 184. The mounting rods 189 are clampable in their supporting bores by means of suitable clamping screws 191.

On another transverse tie member 192, likewise linking the side walls 184, is mounted a guide 193, in an orientation which is perpendicular to the stack table 187. The guide 193 holds a longitudinally displaceable slide 194 of which the extremity facing towards the stack table 187 forms an oblique face 195 which serves as a singulating ramp for the lowermost sheets of the sheet stack 182. A helical compression spring 196, of which one extremity bears against an extension of the guide 193 and the other extremity bears against the slide 194, applies a pressure against the latter in the direction of the stack table 187. An adjustable stop, not shown in the drawing, determines the lower end position of the slide 194. As can be seen in FIG. 19, the feed roll 197 is arranged in alignment with that side of the slide 194 which contacts the guide 193. The stack table 187 is so oriented with respect to the feed roll 197 that its upper side, supporting the sheet stack 182, is at least approximately aligned with a tangent plane of the feed roll 197. This alignment causes the lowermost single sheet of the sheet stack 182 be guided straight from the stack table 187 onto the periphery of the feed roll 197. Provided the setting of the end stop of the slide 194 is correct, the latter will retain all the sheets above the lowermost one, until that single sheet has been singulated forwardly by the feed roll 197. In order to enhance the singulating action of the feed roll 197, the latter has on its circumference a rubber rim 198 of increased surface coarseness. The feed roll 197 is guided on its two extremities in the side walls 184 of the frame 183. It receives its drive through a timing belt 199, from an electric motor 200 which is preferably a gear motor.

As can be seen in FIG. 19, the stack feeder 181 is arranged so close to the guide table 176 of the cutting unit 160 that the single sheets which are drawn from the sheet stack 182 by the feed roll 197 reach the guide table 176 very quickly, after only a short intermediate travel distance. The upper side of the guide table 176 thus serves as a guide surface for the movement of the leading edge of the singulated sheet from the sheet stack 182 in the direction of the cutting unit 160. And, before the singulated data carrier sheet has completely left the feed roll 197, it is engaged by the feeding wheels 180 and advanced forcibly by the latter.

The feeding wheels 180, strictly speaking, may be provided in the form of a number of separate wheels which are arranged on a common shaft, axially spaced apart on the latter. However, the embodiment shown in FIG. 21 features an assembly in which the feeding wheels 180, for reasons of simplicity, represent axially spaced, collar-like length portions of an integral rotational body, the collar like feeding wheels or rims being set apart by intermediate length portions of smaller diameter. These length portions of smaller diameter may simply be in the form of annular grooves 201 which, in the case of a rotational body of rubber, may be formed as part of the original body, or which may be created in a machining operation on an originally cylindrical body. In all cases, it is convenient to refer to the driving portions of larger diameter as feeding wheels 180. These feeding wheels are seated on a shaft 202 which is journalled on its extremities by means of ball bearings 203. Each of these ball bearings 203 is seated in a separate bearing flange 204 of approximately trapezoidal outline, being visible in FIG. 22. These bearing flanges 204 are received inside matchingly shaped apertures of the flange portions 168 of the main frame 167 and clamped to the latter by means of appropriate screws (not shown). As can further be seen in FIG. 22, the receiving aperture 205 in the bearing flange 204 for the ball bearing 203 is oblong in shape, so that the ball bearing 203, holding the extremity of the shaft 202, has a certain freedom of displacement in the vertical direction. Each bearing flange 204 further has two vertically aligned bores 206 and 207 in the upper and lower portions of the flange, in alignment with the plane of the receiving bore 205. These two bores are provided with threads. A matching positioning screw 208 is received in the lower threaded bore 206, so as to support the outer race of the ball bearing 203 in the aperture 205.

In the upper threaded bore 207 is arranged a compression spring 209, held in place by a set screw 211. The compression spring 209 serves to bias the ball bearing 203 into abutment against the positioning screw 208. With this arrangement of the bearing support for the shaft 202 of the feeding wheels 180, it is possible to adjust the latter for any desired distance between their periphery and the guide table 176, for an optimal feeding operation on the singulated sheets from the sheet stack 182. If it should happen that two or more sheets are stuck together and are fed into the device simultaneously, then the feeding wheels 180 can yield resiliently, and the data carrier sheets are fed to the cutting unit 160 without difficulty.

Figure 21:
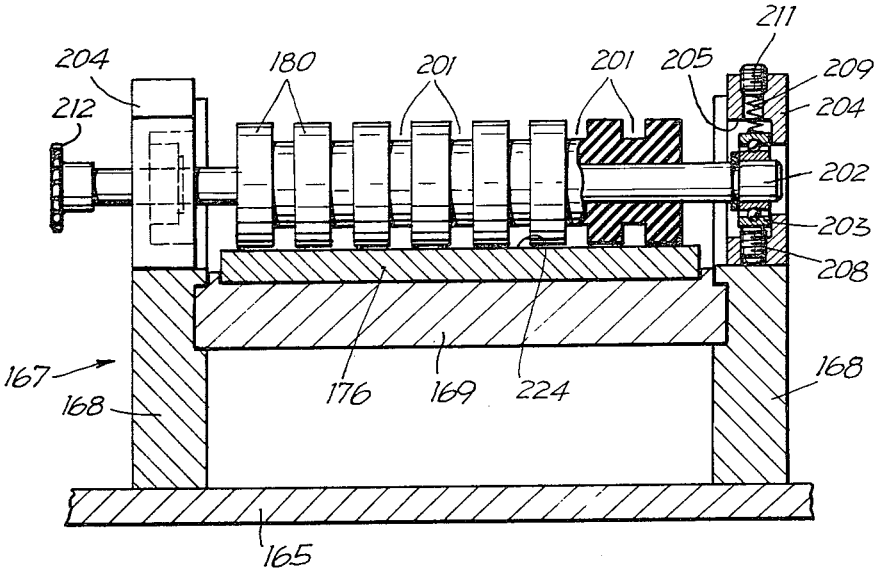
FIG. 21 shows a portion of the device of FIGS. 17 and 18 in a cross section.
Figure 22:
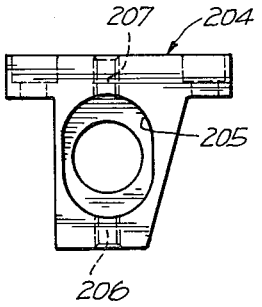
FIG. 22 shows, at an enlarged scale, a further detail of the device of FIGS. 17 and 18.

As can be seen in FIG. 21, the shaft 202 has one extremity which extends beyond the associated bearing flange 204. On this protruding extremity is fixedly mounted a sprocket 212, forming a portion of a chain drive 213. The second sprocket of this chain drive 213 is rotatably journalled on a shaft 215 which, as can be seen in FIG. 18, bottom portion thereof, is mounted on the side wall 184 of the frame 183 of the stack feeder 181. On the same shaft 215 is also arranged a spur gear 216 which is rotatably connected to the sprocket 214. The spur gear 216 cooperates with another spur gear 217 which is fixedly mounted on a shaft trunnion of the feed roll 197 extending beyond the same side wall 184. This gear drive for the feeding wheels 180 drives them in a sense opposite to the rotation of the feed roll 197 which, in turn, receives its drive directly from the electric motor 200.

The gear ratio for this feed drive is such that the circumferential speed of the feed wheels 180 is at least as high, or perhaps slightly higher, than the circumferential speed of the feed roll 197, so that any backup of the data carrier sheets between the feed roll 197 and the feeding wheels 180 is safely prevented.

On each of the two narrow sides of the slide 194 is arranged a guide roller 218 (FIG. 18) which is supported by a journal pin (not shown). The two guide rollers 218 have guide flanges 219 on both extremities. These guide rollers are used, when microfilm on reels is to be shredded, the guide rollers 218 guiding the film into the device.

On still another transverse tie member 220, which is likewise clamped between the two side walls 184 of the frame 183, are mounted guide members in the form of narrow, reed-like elastic guide tongues 221. These guide tongues 221 extend forwardly from the tie member 220, through the space provided by the annular grooves 201 of the feed wheels 180, to the cutting station. The guide tongues 221 have approximately the same configuration, and above all, they serve the same function, as the guide tongues 148 of FIGS. 15 and 16 of an earlier-described embodiment.

As can further be seen in FIG. 19, the device includes a cutter shroud 222 above the milling cutter 170 of the cutting unit 160. The shroud 222 has a shape which envelops the cutter 170 in the form of one-half of a hollow cylinder. In the axial sense, the shroud 222 extends over the entire distance between the two flange portions 168. Only a small gap remains between the shroud extremities and the adjacent flange portions 168, as would be necessary to remove the shroud 222 from its normal position. On the side opposite the cutting station, the shroud 222 is pivotably supported by means of a hinge 223. The pivot pin for the hinge 223 is seated in appropriate bores of the flange portions 168 of the frame 167. The axis of the hinge 223 lies in the plane of the guide surface 224 of the guide table 176 which also provides the stationary cutting edge 161. It follows that, for an initial small pivoting movement of the shroud 222, its edge portion 225 opposite the hinge 223 will move practically perpendicularly to the guide surface 224. The edge portion 225 of the shroud 222 thus rests on the guide surface 224 between the cutter 170 and the feed wheels 180. In order to permit the passage of the data carrier material underneath the edge portion 225, the latter is provided with an entry taper 226, extending over the entire axial width of the shroud 222. In the case of a relatively heavy wall of the shroud 222, this entry taper 226 can be provided directly on the shroud wall, in the form of a chamfer. Alternatively, the edge portion can be bent over to provide the entry taper, as is shown in FIG. 19. It is also possible to attach a separate part to the edge portion 225 for this purpose.

If the cutter shroud 222 is made of metal as, for instance, when one-half of a large brass tube of fairly heavy wall thickness is used, the weight of the shroud itself is sufficient to produce a certain contact pressure between the edge portion 225 and the guide surface 224 of the guide table 176. If necessary, an additional spring member may be used for this purpose. The shroud hinge 223 of FIG. 19 may also be replaced with an appropriate bending hinge, using leaf springs, for example, which would allow for a friction-free pivoting support of the cutter shroud 222. Such a bending hinge would make it possible to conveniently add to the weight of the shroud 222 a certain downward preload, so that even a relatively light shroud can be pressed against the guide surface 224 with sufficient contact pressure to prevent the escape of cut particles from the cutting station.

If, as has been described further above, the guide tongues 221 are to extend as far as the cutting station, then it becomes necessary to provide appropriate recesses 227 in the edge portion 225 of the cutter shroud 222, just above the guide surfaces 224 of the guide table 176. The guide tongues 221 then extend through these recesses 227, while the remainder of the edge portion 225 remains in contact with the guide surface 224. An alternate possibility of a tight seal against the guide table 176 consists in a configuration in which the guide tongues 221 terminate in front of the cutter shroud 222, in which case the shroud edge portion 225 in contact with the guide surface 224 serves as a guide member for the last portion of the data carrier path to the cutting station.

The cutting unit 160 and the surrounding components of the device are enclosed within a cover 228. In its simplest shape, the cover 228 is fitted between the flange portions 168 of the main frame 167 and attached thereto by means of screws. In order to improve the seal of the cutter shroud 222 within the cover 228, the latter carries a ledge 229 of Z-shaped cross section, extending from its rear wall to the shroud hinge 223.

The flange portion of the ledge 229 adjacent the hinge 223 carries a foam rubber strip 230 in contact with the outside of the hinge 223, thereby providing a seal against the shroud 222, without creating appreciable friction.

The base plate 165 is provided with a discharge aperture 231, underneath the cutting station 160, for the passage of the cut particles. Below the discharge opening 231 is arranged a collecting trough 232 which is attached to the underside of the base plate 165 and which continues at a downward incline, in the form of a rectangular chute 233. Over the chute 233 may be inserted a suitable collecting bag for the cut particles, being preferably clamped in place by a suitable clamping mechanism (not shown). In order to improve the guidance of the cut particles from the guide station to the discharge opening 231 there is further provided a guide baffle 234 which is attached to the web portion 169 and reaches into the discharge opening 231.

I claim the following:

1. In a shredding device adapted for the destruction of microfilm and related information carriers with microimage impressions, a shredding unit comprising in combination:

a stationary frame;

a shredding cutter which is rotatably supported on the frame and connected to a cutter drive, the cutter having the general configuration of a cylindrical milling cutter, with an even number of angularly spaced longitudinal cutting edges arranged on the cutter periphery; and a stationary cutting member supported on the frame and forming a stationary cutting edge which is so positioned that it cooperates with the moving cutting edges of the rotating shredding cutter to produce a shearing action therewith; and wherein the stationary cutting edge defines a stationary cutting profile of zigzag outline, similar to the profile outline of a regular screw thread, with triangular teeth and V-shaped grooves;

the moving cutting edges of the shredding cutter define first-position and second-position moving cutting profiles alternating with one another along the cutter circumference, both moving cutting profiles having triangular teeth spaced at twice the longitudinal pitch of the cooperating V-shaped grooves of the stationary cutting edge, so as to produce a shearing action with every other of said grooves; and the first position moving cutting edges are longitudinally offset from the second-position moving cutting edges by the amount of said pitch; with the result that at every pass of a moving cutting edge at the stationary cutting edge against an advancing sheet of information carrier, a plurality of short, V-shaped slivers are sheared from the latter.

2. A shredding unit as defined in claim 1, wherein the moving cutting edges of the shredding cutter and the stationary cutting edge of the stationary cutting member are arranged at an inclination to one another, so that the shearing action between them is longitudinally localized, beginning on one longitudinal extremity and ending at the other.

3. A shredding unit as defined in claim 2, wherein the inclination between the cutting edges is the result of a slight helical inclination of the moving cutting edges in relation to the cutter axis.

4. A shredding unit as defined in one of claims 1 through 3, wherein the stationary cutting edge on the stationary cutting member is the leading edge of a curved surface, the curvature of which matches and envelopes a portion of the circular path of the moving cutting edges.

5. A shredding unit as defined in claim 4, wherein the stationary cutting member is adjustably supported by the frame, for adjustment displacements of the stationary cutting edge in a substantially radial direction with respect to the shredding cutter; and the stationary cutting member and the moving cutting edges of the shredding cutter are of such relative hardness that, at least in the new condition of the cutting member, the shredding cutter is capable of machining the stationary cutting edge on the stationary cutting member, as the position of the latter is forcibly adjusted towards the shredding cutter.

6. A shredding unit as defined in claim 5, wherein the cutting edges of the shredding cutter are of hardened tool steel; and the stationary cutting member is of a copper-based machinable alloy of the type which is capable of sustaining sliding friction in contact with the moving cutting edges of the shredding cutter.

7. A shredding unit as defined in claim 1 or claim 2, wherein the stationary cutting member is a guide plate, one side of which serves as a guide surface for information carrier material which is being fed to the stationary cutting edge; and the guide surface of the cutting member carries an anti-friction coating of polytetrafluoroethylene.

* * * * *